US011539126B2

(12) United States Patent
Brossier et al.

(10) Patent No.: US 11,539,126 B2
(45) Date of Patent: Dec. 27, 2022

(54) GUIDED-WAVE BROADBAND MECHANICAL PHASE-SHIFTING DEVICE

(71) Applicant: THALES, Courbevoie (FR)

(72) Inventors: Jérôme Brossier, Fonsorbes (FR); Dimitri Vynohradov, Toulouse (FR); Gilles Navarre, Toulouse (FR); Benjamin Monteillet, Toulouse (FR)

(73) Assignee: THALES, Courbevoie (FR)

( * ) Notice: Subject to any disclaimer, the term of this patent is extended or adjusted under 35 U.S.C. 154(b) by 477 days.

(21) Appl. No.: 16/706,495

(22) Filed: Dec. 6, 2019

(65) Prior Publication Data

US 2020/0185829 A1 Jun. 11, 2020

(30) Foreign Application Priority Data

Dec. 11, 2018 (FR) ..... 1872664

(51) Int. Cl.
*H01Q 3/36* (2006.01)
*H01Q 13/00* (2006.01)
(Continued)

(52) U.S. Cl.
CPC ..... *H01Q 3/08* (2013.01); *H01P 1/182* (2013.01); *H01P 3/123* (2013.01)

(58) Field of Classification Search
CPC .. H01Q 3/08; H01Q 3/30; H01Q 3/32; H01Q 3/36; H01Q 3/26; H01Q 13/00;
(Continued)

(56) References Cited

U.S. PATENT DOCUMENTS 5,276,455 A * 1/1994 Fitzsimmons ..... H01Q 21/0087 342/368
5,999,128 A * 12/1999 Stephens ..... H01Q 3/2676 342/375

(Continued)

FOREIGN PATENT DOCUMENTS

EP 2 343 774 A1 7/2011
EP 3 147 994 A1 3/2017
FR 2 977 381 A1 1/2013

OTHER PUBLICATIONS

Romano, et al., "Low-loss Millimeter-wave Phase Shifters Based on Mechanical Reconfiguration", PIERS Proceedings, Prague, Czech Republic, pp. 902-907, Jul. 6-9, 2015.

(Continued)

*Primary Examiner* — Tho G Phan
(74) *Attorney, Agent, or Firm* — BakerHostetler

(57) ABSTRACT

A device for phase-shifting a radiofrequency signal, includes a first carrier and a second carrier, an input port and an output port for radiofrequency signals, the input port and the output port being formed on the first carrier, the phase-shifting device comprising: a first array of conductive pads that are distributed over the first carrier and run from the input port, a second array of conductive pads that are distributed over the second carrier, the first carrier, the second carrier, the first array of conductive pads and the second array of conductive pads being arranged so as to form a structure for guiding radiofrequency signals of variable length having a rectangular cross section, the first array of conductive pads and the second array of conductive pads being configured such that the length and cross section of the guide structure change, over at least a portion of the path along which the radiofrequency signals propagate through the guide structure, as the second carrier moves relative to the first carrier.

11 Claims, 7 Drawing Sheets

(51) Int. Cl.

| | |
|---|---|
| ***H01P 1/18*** | (2006.01) |
| ***H01Q 3/08*** | (2006.01) |
| ***H01P 3/123*** | (2006.01) |

(58) Field of Classification Search
CPC ..... H01Q 21/00; H01Q 21/06; H01P 3/02; H01P 1/18; H01P 1/182; H01P 3/12; H01P 3/123
See application file for complete search history.

(56) References Cited

U.S. PATENT DOCUMENTS

| | | | | |
|---|---|---|---|---|
| 7,688,268 | B1 * | 3/2010 | West | H01Q 15/14 343/770 |
| 11,296,679 | B2 * | 4/2022 | Guo | H01P 1/184 |
| 2017/0077576 | A1 | 3/2017 | Kirino | |
| 2021/0143557 | A1 * | 5/2021 | Patotski | H01Q 21/08 |
| 2022/0123467 | A1 * | 4/2022 | Li | H01P 1/184 |

OTHER PUBLICATIONS

Kirino, et al., "Various applications of low-cost phased array antennas with mechanical phase shifters", 2014 IEEE—APS Topical Conference on Antennas and Propagation in Wireless Communications (APWC), pp. 67-70, Aug. 3, 2014.

Kirino, et al., "A Variable Phase Shifter Using a Movable Waffle Iron Metal Plate and Its Applications to Phased Array Antennas", IEICE Transactions on Communications, vol. 91-B(6), pp. 1773-1782, Jun. 1, 2008.

* cited by examiner

GUIDED-WAVE BROADBAND MECHANICAL PHASE-SHIFTING DEVICE

CROSS-REFERENCE TO RELATED APPLICATIONS

This application claims priority to foreign French patent application No. FR 1872664, filed on Dec. 11, 2018, the disclosure of which is incorporated by reference in its entirety.

FIELD OF THE INVENTION

The invention relates to a device for phase-shifting a radiofrequency signal. The invention relates in particular, but not exclusively, to the field of space telecommunications, and especially to radar and interferometer instruments.

BACKGROUND

Phase-shifting devices, also referred to as phase shifters, make it possible to delay an electromagnetic wave. They are used in particular in phased-array antennas. One and the same signal is transmitted or received by a plurality of radiating elements. Each radiating element is coupled individually to a phase shifter and to an amplifier. The individually applied phase shift may range from 0° to 360°. The radiation transmitted or received by each of the radiating elements thus interferes with the radiation of the other radiating elements. The beam is produced by the sum of the constructive interferences and may be oriented in a specific direction by varying the phase between the elements according to the predetermined phase law.

The phase shifters of the prior art may be sorted into three large families: ferrite phase shifters, MEMS (microelectromechanical systems) phase shifters and mechanical phase shifters.

Ferrite phase shifters produce a variable insertion phase on the path of a radio signal without changing its physical length. The phase shift is achieved by varying the permeability of the ferrite, which is achieved by varying the driving magnetic field of the phase shifter. Controlling the driving magnetic field requires active circuits for polarizing the magnetic field, which allow very fast switching times to be achieved. This fast switching time is often needed in radar applications, for example for beam switching. However, said active circuits involve substantial heat dissipation, and thus require thermal control. The thermal control, along with the circuits for driving the magnetic field, result in the ferrite phase shifter being complex in structure, which may present a barrier to integration, in particular for a large number of phase shifters to be mounted on a single radar. Lastly, the rejection rate in their manufacture is high.

In MEMS phase shifters, the phase shift is achieved by changing the geometry of a micro-strip line, which modifies the propagation constant of the line. The change in geometry is effected on two axes (line length and line width) by microactuators. One example of a MEMS phase shifter is described in the document "*Low-loss Millimeter-wave Phase Shifters Based on Mechanical Reconfiguration*" (Romano et al., PIERS Proceedings, Prague, Czech Republic, Jul. 6-9, 2015). However, these phase shifters do not allow high powers, due to the size of the microactuators. Furthermore, the phase shift is generally not constant over a wide bandwidth. These phase shifters are therefore not especially broadband. Lastly, their lifespan is limited.

Mechanical phase shifters, for example "slide-trombone" phase shifters, are simpler in design in comparison with ferrite phase shifters and MEMS phase shifters, and generally allow high powers with low losses. "Slide-trombone" phase shifters comprise a movable portion and a conductive branch. The movable portion is hollow and its diameter is greater than the diameter of the conductive branch, which allows the movable portion to slide along the conductive branch in a translational motion in order to adjust the phase shift. One example of a "slide-trombone" phase shifter in association with a power splitter is described in document FR 2 977 381. In this type of structure, the cross section remains constant while the length varies. Thus, the phase modification is not the same depending on the frequency of the signal. "Slide-trombone" phase shifters are therefore not broadband.

Document US 2017/0077576 A1 describes a mechanical phase shifter comprising a fixed plate fitted with an array of pads and a movable plate fitted with a row of pads. The signals to be phase-shifted are transmitted through a guide structure composed of a ridge, located on the fixed plate, and of the row of pads. As the movable plate moves transversely with respect to the ridge, the row of pads gets further away from the ridge, and the length of the path for the electric current flowing through the waveguide decreases. The guide structure described in document US 2017/0077576 A1 does not offer much amplitude in the movement between the two plates, which limits the phase shift applied. Specifically, the movement is limited so as to prevent the row of pads on the movable plate and the array of pads on the fixed plate coming into contact with one another, which would lead to unwanted friction between the parts.

SUMMARY OF THE INVENTION

The invention therefore aims to obtain a phase shifter that is easy to manufacture, broadband, allows high power levels and exhibits little or no heat dissipation.

One subject of the invention is therefore a device for phase-shifting a radiofrequency signal, comprising a first carrier and a second carrier, the first carrier and the second carrier being mounted so as to allow relative movement, an input port and an output port for radiofrequency signals being formed on the first carrier, the phase-shifting device comprising:

a first array of conductive pads that are distributed over the first carrier and run from the input port, a second array of conductive pads that are distributed over the second carrier, the first carrier, the second carrier, the first array of conductive pads and the second array of conductive pads being arranged so as to form a structure for guiding radiofrequency signals of variable length having a rectangular cross section that connects the input port and the output port, the first array of conductive pads and the second array of conductive pads being configured such that the cross section and the length of the guide structure change, over at least a portion of the path along which the radiofrequency signals propagate through the guide structure, as the first carrier moves relative to the second carrier.

Advantageously, the device comprises:

a first short-circuit portion is arranged in proximity to the input port, and configured to constrain the propagation of the radiofrequency signals from the input port to the guide structure;

a second short-circuit portion is arranged in proximity to the output port, and configured to constrain the propagation of the radiofrequency signals from the guide structure to the output port.

Advantageously, the first array of conductive pads and the second array of conductive pads are coupled to a guided portion of constant dimensions at a first access, the guided portion of constant dimensions being coupled, at a second access, to a third array of conductive pads and to a fourth array of conductive pads, the third array of conductive pads and the fourth array of conductive pads being arranged on the first carrier and the second carrier, respectively, the guide structure also being formed by the third array of conductive pads and by the fourth array of conductive pads such that the cross section of the guide structure changes, at the third array of conductive pads and the fourth array of conductive pads, as the first carrier moves relative to the second carrier.

Advantageously, the second carrier and the first carrier take the shape of cylinders about one and the same axis Z, the first array of conductive pads comprising a first helical portion on the axis Z, the second array of conductive pads comprising a second helical portion on the axis Z, the first helical portion and the second helical portion being inclined by one and the same predetermined slope.

Advantageously, the first array of conductive pads and the second array of conductive pads each comprise two straight portions which lie mostly in planes that are orthogonal to the axis Z and are arranged on either side of the first helical portion and the second helical portion, respectively.

Advantageously, the second carrier is configured so as to be able to rotate within the first carrier about the axis Z, the guided portion of constant dimensions passing diametrically through the second carrier on distinct planes along the axis Z from the first access to the second access.

Advantageously, the second carrier is configured so as to be able to rotate about the first carrier, the input port and the output port being coaxial to the axis Z, the input port being connected to the first array of conductive pads and to the second array of conductive pads via a first elbowed guide, the output port being connected to the third array of conductive pads and to the fourth array of conductive pads via a second elbowed guide, the guided portion of constant dimensions being arranged around at least a portion of the annular periphery of the second carrier.

Advantageously, the third array of conductive pads comprises a third helical portion and a fourth array of conductive pads comprising a fourth helical portion, the third helical portion and the fourth helical portion being inclined by the predetermined slope and being coupled at the end to the output port.

Advantageously, the second carrier and the first carrier take the shape of cylinders about one and the same axis Z, the second carrier being configured so as to be able to rotate within the first carrier, a pin being arranged within a void in the second carrier, the pin and the void being configured such that the rotation of the second carrier about the axis Z results in a translational movement of the second carrier.

Advantageously, the void takes a curved shape, the curved shape being configured so as to compensate for a nonlinearity in the phase variation as the second carrier rotates about the axis Z.

Advantageously, the second carrier and the first carrier are planar in shape and located one above the other with constant height, the second carrier being able to move relative to the first carrier along an axis of translation, the first array of conductive pads comprising two first rectilinear portions that run parallel to the axis of translation, the two first rectilinear portions being connected to one another by their ends via a first inclined portion at a predetermined angle relative to the axis of translation, the second array of conductive pads comprising two second rectilinear portions that run parallel to the axis of translation, the two second rectilinear portions being connected to one another by their ends via a second inclined portion at the predetermined angle relative to the axis of translation, the third array of conductive pads and the fourth array of conductive pads being arranged symmetrically with respect to a median plane containing the axis of translation, the input port and the output port being arranged symmetrically on either side of the median plane, the guided portion of constant dimensions being arranged under the second carrier, on the side opposite the first carrier.

BRIEF DESCRIPTION OF THE DRAWINGS

Other features, details and advantages of the invention will become apparent upon reading the description provided with reference to the appended drawings, which are given by way of example and in which, respectively.

DETAILED DESCRIPTION

The principle on which the invention is based consists in passing a radiofrequency signal through a guided structure of rectangular section, the electrical length "L" and the long side "a" of which vary simultaneously, in finite proportions. The variation in the long side is thus dependent on the variation in the electrical length. The proposed solution makes it possible, with a single degree of freedom, to vary the two degrees of freedom of phase variation in the guide. The advantage in using a waveguide in a guide structure of rectangular section makes it possible to limit ohmic losses and to allow high-power radiofrequency signals. The term "rectangular section" is understood to refer both to guided structures of purely rectangular section and to rectangular guided structures featuring ridges. The presence of ridges allows the frequency band to be widened.

Since the cutoff wavelength and the characteristic propagation constant of the guide are dependent on the long side of a rectangular guide structure, the output phase of the phase shifter may be adjusted by adjusting the dimensions of the long side.

Figure 1A:
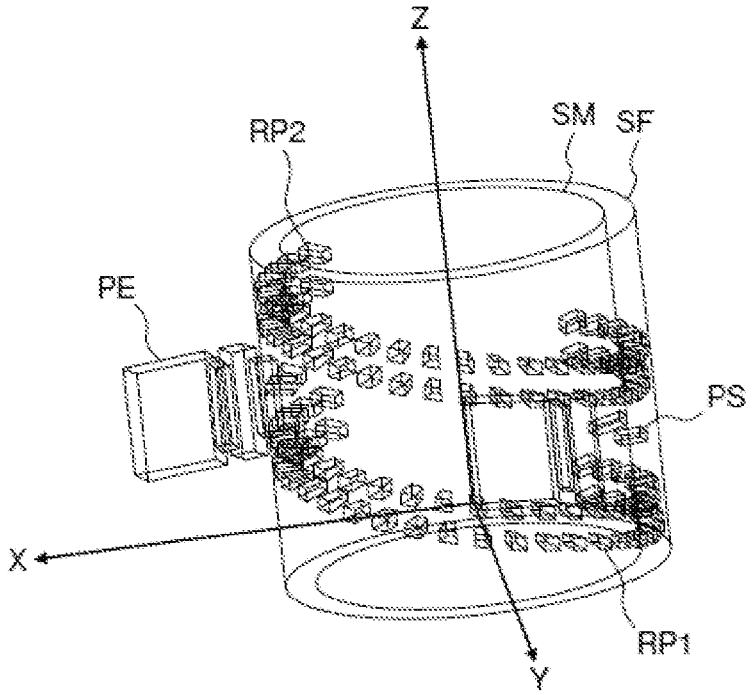
FIG. 1A is a first depiction of the phase-shifting device according to the invention, allowing a phase shift from 0° to 180°, according to a cylindrical embodiment.
Figure 1B:
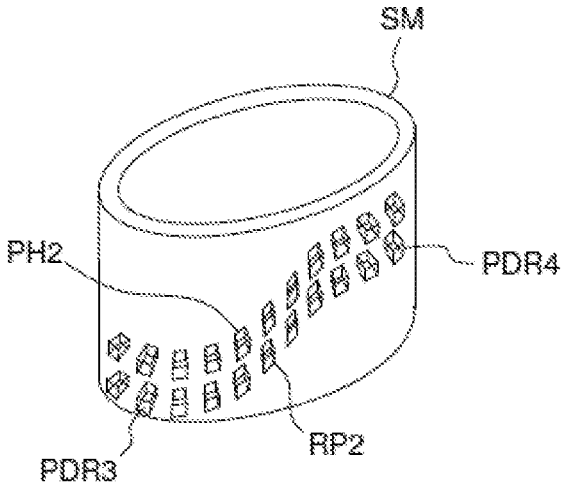
FIG. 1B is a second depiction of the phase-shifting device according to the invention, allowing a phase shift from 0° to 180°, according to a cylindrical embodiment.
Figure 1C:
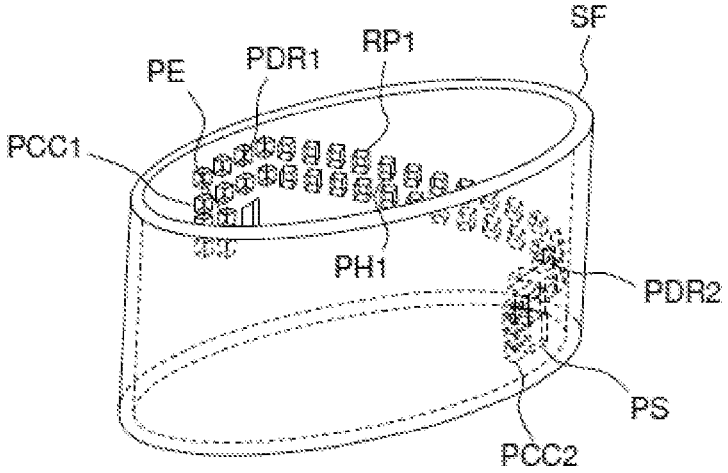
FIG. 1C is a third depiction of the phase-shifting device according to the invention, allowing a phase shift from 0° to 180°, according to a cylindrical embodiment.

Variations in the electrical length "L" and in the long side "a" may advantageously be combined by means of a rotational movement. FIGS. 1A, 1B and 1C illustrate a first embodiment of the phase shifter according to the invention. In particular, FIG. 1A illustrates a perspective view of the phase shifter according to the first embodiment. The phase shifter has an input port PE and an output port PS, which may be embodied for example by guided accesses of rectangular section. The input port PE and the output port PS are formed on a first carrier SF. The first carrier SF is cylindrical in shape. A second carrier SM, which is also cylindrical in shape, is arranged concentrically within the first carrier SF with the same axis of revolution Z. The first carrier SF is hollow, so as to allow the second carrier SM to rotate within the first carrier about the axis Z. The first carrier SF and the second carrier SM thus form a stator/rotor pair. A first array of conductive pads RP1 is distributed over the first carrier SF; it runs from the input port PE to the output port PS. A second array of conductive pads RP2 is distributed over the second carrier SM; it also runs from the input port PE to the output port PS. The first array of conductive pads RP1 and the second array of conductive pads RP2, the first carrier SF and the second carrier SM define a guide structure between the input port PE and the output port PS.

The conductive pads are configured to couple the electromagnetic field of the radiofrequency signal over a large bandwidth. They are periodic in that the same pad is reproduced locally over a determined area, with a period determined in particular according to the working frequency. They may be formed of a bulk conductive material, for example a metal. As a variant, they may be coated with a conductive, in particular metal, surface. They form electromagnetic walls defining a communication channel located between the first carrier SF and the second carrier SM. The conductive pads may be cylinders of revolution, or prisms, or even be conical in shape, thereby conferring a broadband character on the array of conductive pads. More generally, the conductive pads may take any shape that protrudes with respect to the carrier on which they are arranged.

The height of the conductive pads of the first array of conductive pads RP1 and the second array of conductive pads RP2 is substantially equal to the spacing between the first carrier SF and the second carrier SM, while still leaving a clearance between the end of each pad and the carrier opposite, facing it. To avoid all contact between the first carrier SF and the second carrier SM, the first array of conductive pads RP1 and the second array of conductive pads RP2 are both inclined by one and the same slope. Thus, as the first carrier SF and the second carrier SM move relative to one another, i.e. as the second carrier SM rotates within the first carrier SF, the second array of conductive pads RP2 comes closer to or moves away from the first array of conductive pads RP1 along the axis Z.

FIG. 1B shows a detail view of the second carrier SM, and FIG. 10 shows a detail view of the first carrier SF. The first array of conductive pads RP1 comprises a first helical portion PH1 on the axis Z, and the second array of conductive pads RP2 comprises a second helical portion PH2 on the axis Z. The first helical portion PH1 and the second helical portion PH2 are inclined by one and the same predetermined slope. The slope is predetermined according to technical constraints, which may be: the frequency band, the maximum phase shift value (+180° or −180°), the dimensions of the long side "a" for a phase shift of zero and the length "L" of the guide structure for a phase shift of zero. For example, for the frequency band 17.7-20.2 GHz, a long side "a" with a value of 10.5 mm, a length "L" with a value of 50 mm, the variations in the long side "a" and in the length "L" may be equal to 1.1 mm (Δa) and 5.8 mm (ΔL), respectively, for a phase shift that is equal to −180°. The values Δa and ΔL allow the slope of the first helical portion PH1 and of the second helical portion PH2 to be calculated.

As illustrated in FIG. 10, a first short-circuit portion PCC1 is arranged in proximity to the input port PE. The first short-circuit portion PCC1 is configured to constrain the propagation of the radiofrequency signals from the input port PE to the guide structure. Similarly, a second short-circuit portion PCC2 is arranged in proximity to the output port PS, and is configured to constrain the propagation of the radiofrequency signals from the guide structure to the output port PS. The first short-circuit portion PCC1 and the second short-circuit portion PCC2 are made up of conductive metal pads arranged in an array, and form an electromagnetic wall to prevent the radiofrequency signal from propagating out of the guide structure. The first short-circuit portion PCC1 is arranged on the input-port PE side, which is opposite the first helical portion PH1, it is furthermore of the same size, along the axis Z, as the input port PE. Similarly, the second short-circuit portion PCC2 is arranged on the output-port PS side, which is opposite the second helical portion PH2; it is furthermore of the same size, along the axis Z, as the output port PS.

The first array of conductive pads RP1 comprises a first straight portion PDR1, which runs, at constant height relative to Z, from the first short-circuit portion PCC1 to the first helical portion PH1. The length of the first straight portion PDR1, between the first short-circuit portion PCC1 and the first helical portion PH1, is roughly equal to the wavelength of the guide structure. Similarly, a second straight portion PDR2 runs, at constant height relative to Z, from the second short-circuit portion PCC2 to the first helical portion PH1. The structure of the second array of conductive pads RP2, arranged on the second carrier SM, is similar to the structure of the first array of conductive pads RP1, namely: a third straight portion PDR3, a second helical portion PH2 and a fourth straight portion PDR4. The length of the third straight portion PDR3 and the length of the fourth straight portion PDR4 are such that, during a rotation corresponding to a maximum phase shift (for example +180° or −180°), the third straight portion PDR3 and the fourth straight portion PDR4 are always positioned facing the first straight portion PDR1 and facing the second straight portion PDR2, respectively. Thus, the arrangement of the first straight portion PDR1 and the fourth straight portion PDR4 allows the section of the guide structure at the input port PE to be invariant, and the arrangement of the second straight portion PDR2 and of the third straight portion PDR3 allows the section of the guide structure at the output port PS to be invariant, thereby improving the radio performance of the phase shifter.

Figure 2A:
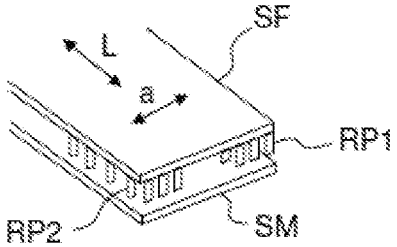
FIG. 2A is a first depiction of the arrays of conductive pads on the fixed and movable carriers in a perspective view.
Figure 2B:
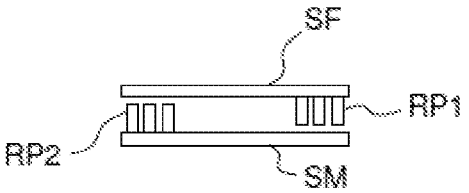
FIG. 2B is a second depiction of the arrays of conductive pads on the fixed and movable carriers in a cross-sectional view.

FIGS. 2A and 2B illustrate a perspective view and a cross-sectional view, respectively, of the guide structure defined by the first carrier SF, by the second carrier SM, by the first array of conductive pads RP1 and by the second array of conductive pads RP2. As the second carrier SM rotates within the first carrier SF, the length "L" and the long side "a" vary in accordance with the predetermined slope. According to the example in FIGS. 1B and 10, rotating the second carrier SM in the anticlockwise direction results in an increase in the long side "a". Conversely, rotating the second carrier SM in the clockwise direction results in a decrease in the long side "a". It goes without saying that the input port PE and the output port PS may be arranged differently, i.e. an output port PS arranged at a height above that of the input port PE along the axis Z. Similarly, the slope connecting the input port PE to the output port PS may "descend" in the anticlockwise direction, as illustrated in FIGS. 1B and 10, or, alternatively, "descend" in the clockwise direction.

As illustrated in FIG. 2B, the first carrier SF and the second carrier SM are arranged facing one another while leaving a clearance between the end of each pad and the carrier opposite, facing it. Thus, there is advantageously no contact between the first carrier SF and the second carrier SM. In cross section, the first array of conductive pads RP1 is not arranged across the entire width of the guide structure, and the second array of conductive pads RP2 is not arranged over the entire width of the guide structure. Thus, the guide structure is defined by the portion of the first carrier SF that is devoid of pads and has no pads facing it, and by the portion of the second carrier SM that is devoid of pads and has no pads facing it. The guide structure thus forms a parallel-plate waveguide, the arrays of conductive pads (RP1, RP2) of which allow electromagnetic waves to be channelled while limiting leakages.

Figure 3:
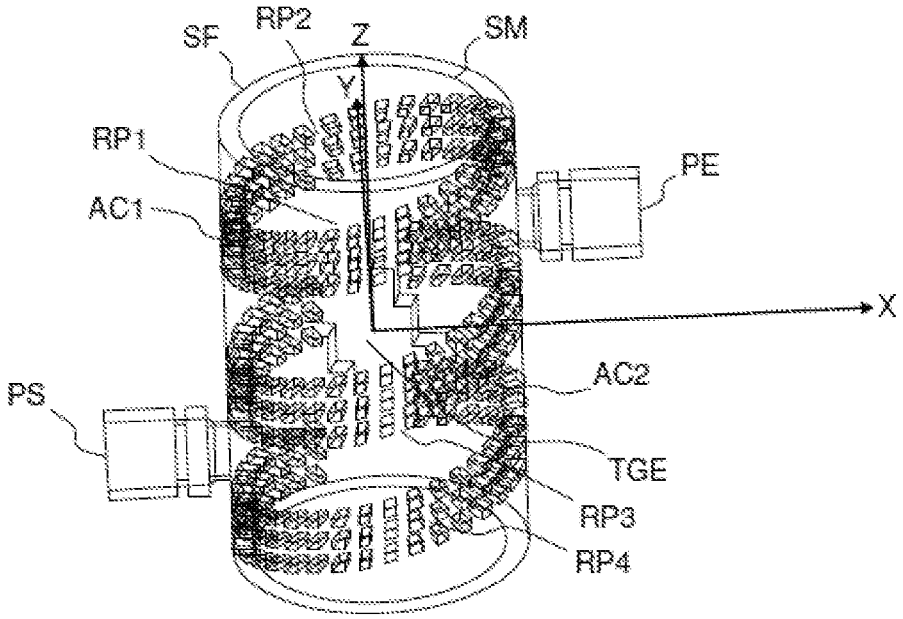
FIG. 3 is a depiction of the phase-shifting device according to the invention, allowing a phase shift from 0° to 360°, according to a cylindrical embodiment in which the second carrier rotates within the first carrier.

FIG. 3 illustrates one variant of the phase-shifting device according to the invention. The embodiment illustrated by FIG. 3 corresponds to the superposition of two phase-shifting devices according to FIG. 1A. It thus makes it possible, with a phase-shifting device of constant diameter, to apply a phase shift having a maximum value that is twice as high as for the embodiment described above. In particular, the embodiment illustrated by FIG. 3 make it possible to achieve a maximum phase shift of 180° on a first stage, followed by a new maximum phase shift of 180° on a second stage. A maximum phase shift of 360° may thus be achieved. A phase-shifting device illustrated by FIG. 1A would also allow a maximum phase shift of 360° by doubling the diameter of the first carrier SF and of the second carrier SM.

Rotating the second carrier SM within the first carrier SF causes the helical portions of the first array of conductive pads RP1 and the second array of conductive pads RP2 to move closer to or further away from one another. The first array of conductive pads RP1 and the second array of conductive pads RP2 are coupled to a guided portion of constant dimensions TGE at a first access AC1. The signal phase-shifted by half the desired value is therefore retrieved at the first access AC1. The guided portion of constant dimensions TGE passes diametrically through the second carrier SM on distinct planes along the axis Z from the first access AC1 to a second access AC2. The guided portion of constant dimensions TGE is depicted in FIG. 3 as a staircase waveguide, but other types of guided portions may be envisaged, for example a sloped guide. What matters is that the phase shift of the radiofrequency signal introduced into the guided portion of constant dimensions TGE is constant for a given frequency, whatever the relative position between the first carrier SF and the second carrier SM. A short-circuit portion (not shown) makes it possible to constrain the radiofrequency signal so that it travels through the guided portion of constant dimensions TGE after passing through the portion of the guide structure defined by the first array of conductive pads RP1 and by the second array of conductive pads RP2. Similarly, a short-circuit portion may be arranged in proximity to the second access AC2. The short-circuit portions may be formed by arrays of conductive pads. The guided portion of constant dimensions TGE is coupled, at the second access AC2, to a third array of conductive pads RP3, arranged on the first carrier SF, and to a fourth array of conductive pads RP4, arranged on the second carrier SM. At the end, the third array of conductive pads RP3 and the fourth array of conductive pads RP4 are coupled to the output port PS. As the second carrier SM rotates within the first carrier SF, the helical portions of the second array of conductive pads RP2 and of the fourth array of conductive pads RP4 come closer to or move away from the helical portions of the first array of conductive pads RP1 and of the third array of conductive pads RP3, respectively.

The change in the plane along the axis Z, made possible by the guided portion of constant dimensions TGE, thus prevents all mechanical interference between the various arrays of conductive pads for phase shifts of greater than 180°.

A phase-shifting device on two planes may in particular be implemented when $\Delta L/R>180°$, where $\Delta L$ represents the electrical length of the guide structure in the helical portions and R represents the radius of the first carrier SF and of the second carrier SM (which are substantially identical, to within the height of the conductive pads).

The first carrier SF and the second carrier SM may be obtained by mechanical assembly. Other means such as additive manufacture or electroforming may also be envisaged.

The phase-shifting device according to the invention may, as a variant, be produced with planar carriers. This is the view produced from the perimeter of the cylindrical embodiment illustrated by FIG. 1A.

The first carrier SF" and the second carrier SM" are planar in shape and located one above the other with constant height. The constant height corresponds to the height of the conductive pads, but with a clearance between the end of each pad and the carrier opposite, facing it, so as to allow the second carrier SM" and the first carrier SF" to move relative to one another along an axis of translation X without contact. The first array of conductive pads RP1" is arranged on the first carrier SF" and the second array of conductive pads RP2" is arranged on the second carrier SM". The first array of conductive pads RP1" and the second array of conductive pads RP2" are thus arranged between two plates formed by the first carrier SF" and the second carrier SM". The input port PE and the output port PS are arranged on the first carrier SF". In particular, the input port PE and the output port PS may be embodied by guided accesses. A first short-circuit portion PCC1" is arranged in proximity to the input port PE and a second short-circuit portion PCO2" is arranged in proximity to the output port PS. The first array of conductive pads RP1" comprises two first rectilinear portions PRE1, PRE2, which run parallel to the axis of translation X. The two first rectilinear portions (PRE1, PRE2) are connected to one another by their ends via a first inclined portion P11 at a predetermined angle θ relative to the axis of translation X. The predetermined angle θ corresponds to the predetermined slope in the cylindrical embodiment. The predetermined angle θ sets the variation in the long side "a" according to the length "L", in the same way as the steepness of the slope in the cylindrical embodiment. The second array of conductive pads RP2" comprises two second rectilinear portions (PRE3, PRE4) that run parallel to the axis of translation X. The two second rectilinear portions (PRE3, PRE4) are connected to one another by their ends via a second inclined portion P12 at the predetermined angle (θ) relative to the axis of translation X. The inclined portions (P11, P12) are located away from the input and output ports by a distance that is greater than the wavelength of the guide structure, so as to avoid electromagnetic-field coupling effects.

Figure 4:
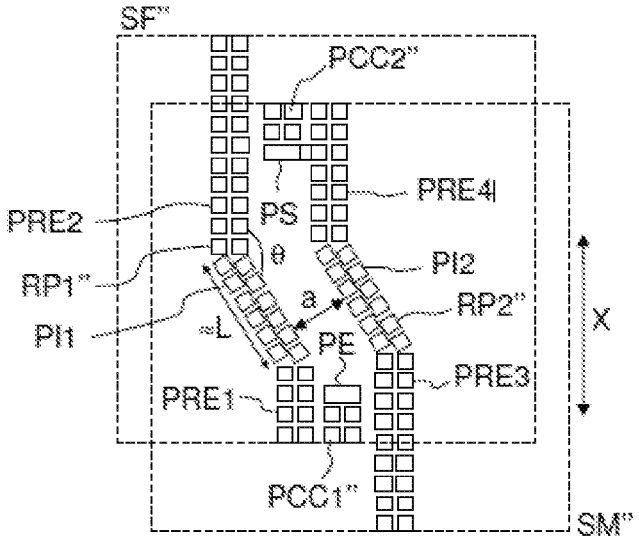
FIG. 4 is a depiction of the phase-shifting device according to the invention, allowing a phase shift from 0° to 180°, according to a planar embodiment.

The first inclined portion P11 and the second inclined portion P12 run parallel to one another. As the second carrier SM" moves relative to the first carrier SF" in a translational motion along the axis X, the long side "a" varies. In the example of FIG. 4, as the second carrier SM" moves "upwards" the long side "a" gets longer, and as the second carrier SM" moves "downwards" the long side "a" gets shorter. Thus, the cross section of the guide structure varies with the translational movement of the second carrier SM" relative to the first carrier SF".

The guide structure forms a parallel-plate waveguide, the arrays of conductive pads of which allow electromagnetic waves to be channelled while limiting leakages.

Figure 5:
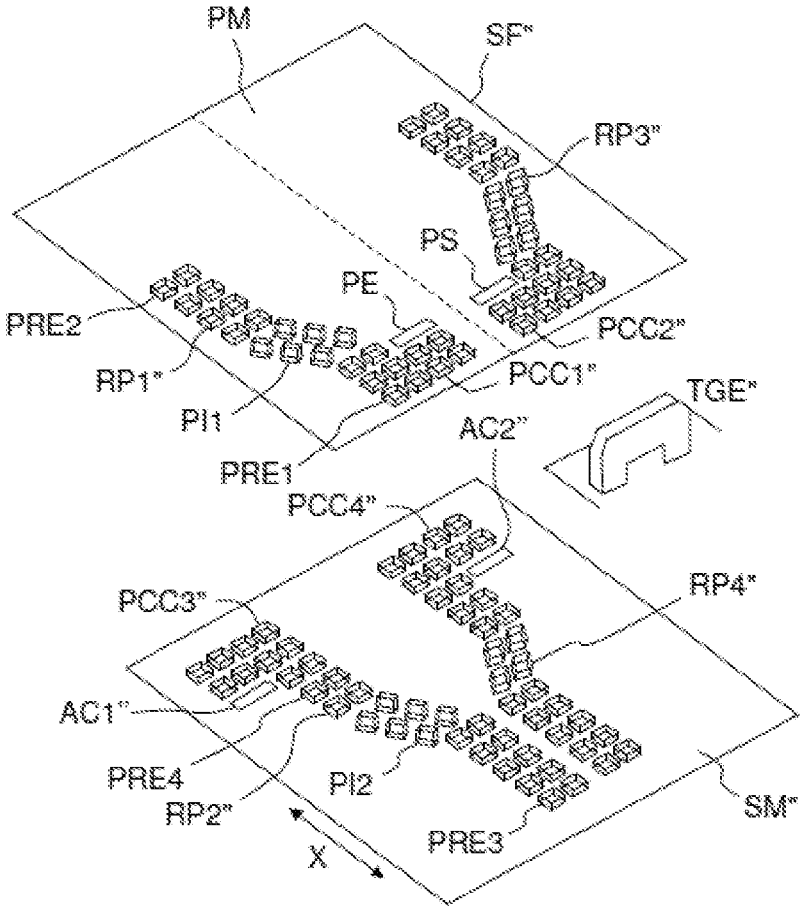
FIG. 5 is a depiction of the phase-shifting device according to the invention, allowing a phase shift from 0° to 360°, according to a planar embodiment.

FIG. 5 illustrates one planar embodiment of the phase-shifting device according to the invention. It makes it possible in particular to double the value of the maximum phase shift between the input port PE and the output port PS with respect to the embodiment described above and illustrated in FIG. 4. In particular, for the same size along the axis X, the embodiment illustrated by FIG. 5 makes it possible to obtain a maximum phase shift of 360°, while the embodiment illustrated by FIG. 4 makes it possible to obtain a maximum phase shift of 180°. The first array of conductive pads RP1" is arranged on the first carrier SF" and the second array of conductive pads RP2" is arranged on the second carrier SM". They are identical to those described in the preceding embodiment illustrated by FIG. 4. The distance separating the first carrier SF" from the second carrier SM" corresponds to the height of the conductive pads. A first access AC1" is located on the second carrier SM", in proximity to the fourth rectilinear portion PRE4. A third array of conductive pads RP3" and a fourth array of conductive pads RP4" are arranged symmetrically with respect to a median plane PM containing the axis of translation X. The input port PE and the output port PS are arranged symmetrically on either side of the median plane PM. A guided portion of constant dimensions TGE" is arranged under the second carrier SM", on the side opposite the first carrier SF". Thus, the height of the guided portion of constant dimensions TGE" does not hinder the contactless movement of the second carrier SM" in relation to the first carrier SF". The guided portion of constant dimensions TGE" may take the shape of an assembly of two elbowed waveguides. The short-circuit portions (PCC1", PCC2", PCC3", PCC4") are arranged in proximity to the input port PE, the output port PS, the first access AC1" and the second axis AC2", respectively, in order to channel the electromagnetic waves of the radiofrequency signal.

Figure 6A:
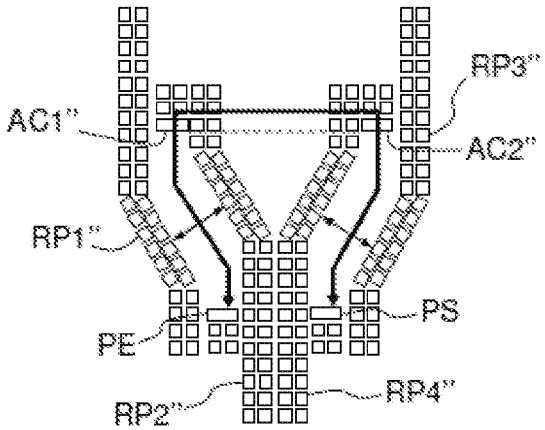
FIG. 6A is a view of the phase-shifting device in FIG. 5 in an initial state.
Figure 6B:
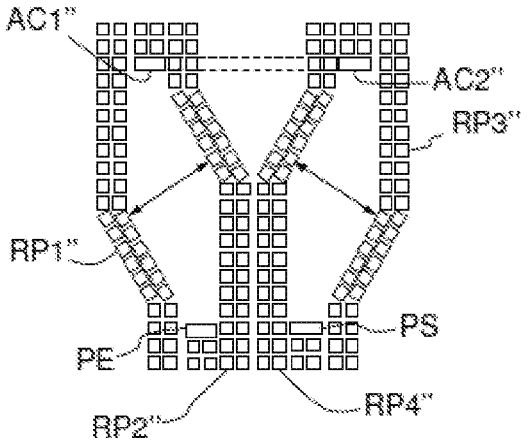
FIG. 6B is a view of the phase-shifting device in FIG. 5 in a state in which the length and width of the guide structure are increased.
Figure 6C:
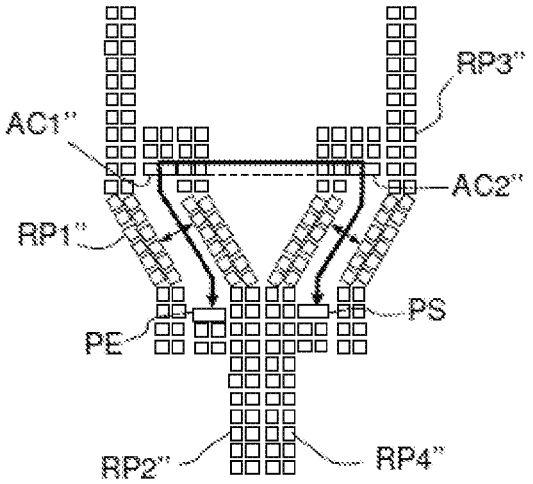
FIG. 6C is a view of the phase-shifting device in FIG. 5 in a state in which the length and width of the guide structure are decreased.

FIGS. 6A, 6B and 6C schematically illustrate the variation in the long side "a" of the guide structure according to the guide length "L". The guide length "L" is varied by translating the second carrier SM" in relation to the first carrier SF".

When they are planar, the second carrier SM" may be placed on a carriage that can be moved in translation relative to the first carrier SF". The phase-shifting device according to the planar embodiment may be manufactured using conventional machining techniques.

Figure 7A:
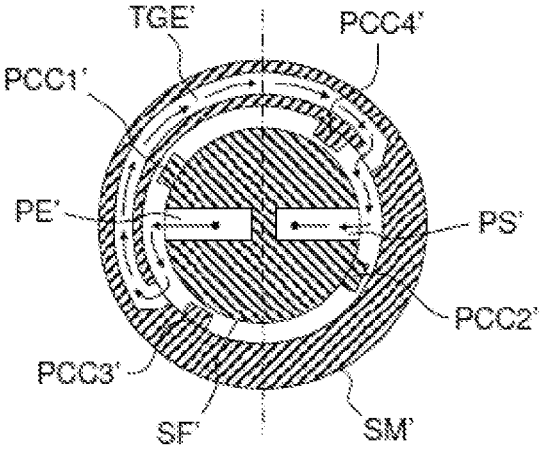
FIG. 7A is a cross-sectional depiction of the phase-shifting device according to the invention, allowing a phase shift from 0° to 360°, according to a cylindrical embodiment in which the second carrier rotates about the first carrier.
Figure 7B:
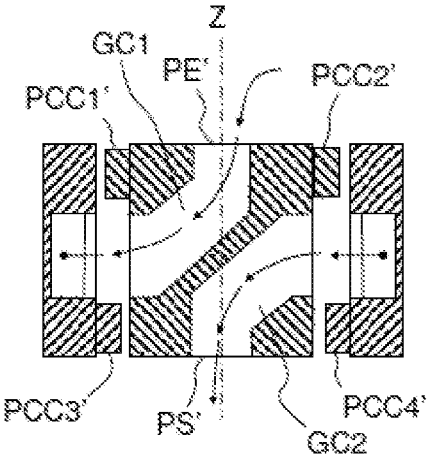
FIG. 7B is a longitudinal-sectional depiction of the phase-shifting device according to the invention, allowing a phase shift from 0° to 360°, according to a cylindrical embodiment in which the second carrier rotates about the first carrier.

FIGS. 7A and 7B are cross-sectional (plane XY) and longitudinal-sectional (plane XZ) depictions, respectively, of the phase-shifting device according to the invention, allowing a phase shift from 0° to 360°, according to a cylindrical embodiment in which the second carrier SM' rotates about the first carrier SF'.

The second carrier SM' is able to rotate about the first carrier SF'. The input port PE' and the output port PS' are arranged on the first carrier SF', and are coaxial to the axis Z, as illustrated more specifically in FIG. 7B. The input port PE' is connected to the first array of conductive pads and to the second array of conductive pads via a first elbowed guide GC1. The output port PS' is connected to the third array of conductive pads and to the fourth array of conductive pads via a second elbowed guide GC2. The first elbowed guide GC1 and the second elbowed guide GC2 must be designed so as to prevent the radiofrequency signal from being reflected. To achieve this, the first elbowed guide GC1 may have an angle of 90° between its ends, and comprise two elbows at 45°, spaced apart by λ/4. The second elbowed guide GC2 may be designed in a similar fashion. The guided portion of constant dimensions TGE' is arranged around at least a portion of the annular periphery of the second carrier SM'. The height of the guided portion of constant dimensions TGE' is thus constant relative to the axis Z.

A first short-circuit portion PCC1' is arranged in proximity to the input port PE' and configured to constrain the propagation of the radiofrequency signals from the input port PE' to the guide structure. Similarly, a second short-circuit portion PCC2' is arranged in proximity to the output port PS', and is configured to constrain the propagation of the radiofrequency signals from the guide structure to the output port PS'. Short-circuit portions (PCC3', PCC4') make it possible to channel the electromagnetic waves of the radiofrequency signal in proximity to the accesses leading to the guided portion of constant dimensions TGE'. The arrays of conductive pads are not shown for the sake of clarity of the drawings. They are also formed of helical portions, and may also comprise straight portions on either side of the helical portion, so as to ensure that the section of the guide structure is invariant as the second carrier SM' is rotated.

Rotating the second carrier SM' lengthens or shortens the length "L" of the guide structure. The variation in the long side "a" may be obtained via the helical shape of the guided zone between the rotor and the stator. The axial arrangement of the input port PE' and of the output port PS' may be dictated by constraints in the integration and arrangement of the phase-shifting device in relation to other components.

It is possible to double the maximum phase-shift value in the embodiment illustrated by FIGS. 7A and 7B by coupling the output port PS' to another input port located on a lower plane on the axis Z.

Figure 8A:
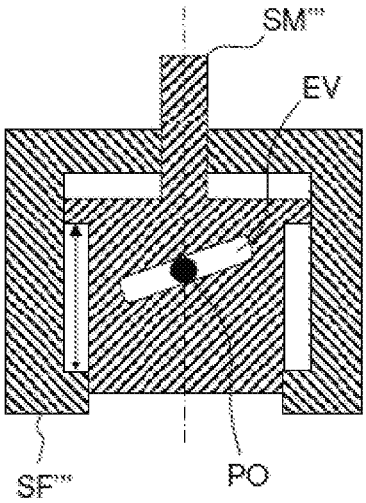
FIG. 8A is a first depiction of the phase-shifting device according to the invention according to a cylindrical embodiment with pin.
Figure 8B:
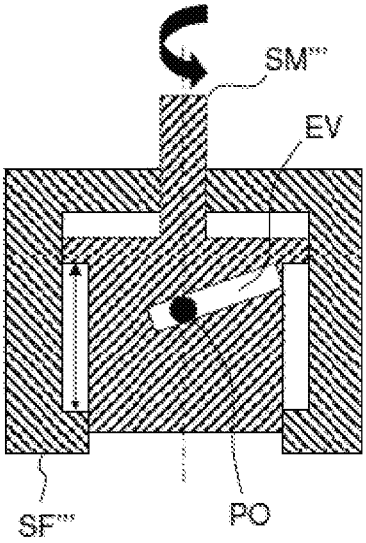
FIG. 8B is a second depiction of the phase-shifting device according to the invention according to a cylindrical embodiment with pin.

As a variant of the phase-shifting device according to the invention, the variation in the long side "a" may be obtained via a mechanical pin device. FIGS. 8A and 8B show a sectional view through the longitudinal plane of the phase-shifting device before and after, respectively, rotation of the second carrier SM'''. The second carrier SM''' and the first carrier SF''' take the shape of cylinders about one and the same axis Z. The second carrier SM''' is configured so as to be able to rotate within the first carrier SF'''. A pin PO is arranged in a fixed manner within a void EV in the second carrier SM''' in the axis of rotation Z of the second carrier SM'''.

The void EV may be linear in shape, and may thus be inclined by a predetermined slope which corresponds to the slope and to the angle described in the preceding embodiments.

As a variant, the void may take a curved shape so as to cause a nonlinear variation in the long side "a" of the guide structure. Thus, a potential natural nonlinearity in the phase-shifting device may be compensated for in the rotation of the second carrier SM'''. A constant phase shift is guaranteed for a given rotation step (for example exactly 10 motor steps for a phase shift by 5°, and exactly 10 additional motor steps for a phase shift by 10°). The work for the user is thus simplified.

In particular, the pin may consist of a ball, and the void EV may be for example a hollow cylinder, the height of which is equal to the diameter of the ball. Rotating the second carrier SM''' results in the pin PO moving within the void EV and, by means of a pin PO indexing mechanism, a translational movement of the second carrier SM''' parallel to the axis of rotation. The arrays of conductive pads defining the guide structure are arranged annularly between the first carrier SF''' and the second carrier SM'''. The spacing between the first array of conductive pads and the second array of conductive pads (long side "a") varies with the rotation of the second carrier SM'''. A guided portion of constant dimensions, such as a staircase guide, may advantageously be arranged in the second carrier SM''' so as to double the maximum phase-shift value.

To achieve the rotational motion, a motor or gear motor, such as a stepper motor, may advantageously position, according to a desired angle, the second carrier within the first carrier, or about the first carrier depending on the embodiment envisaged, with sufficient resolution to allow fine adjustment of the phase shift of the radiofrequency signal. A feedback-control device could advantageously form a loop between the desired phase and the relative position of the second carrier with respect to the first carrier.

For high frequencies, the masses of the first carrier and of the second carrier are decreased so that it is not necessary to use roller bearings in the motor. Thus, the phase-shifting device could be incorporated within the motor, which could allow, using a specific internal guide device, the second carrier to rotate within or about the first carrier.

The phase-shifting device described above makes it possible to achieve a phase shift that is near constant to within a degree across an entire bandwidth (typically 15%), thereby conferring a broadband character on the phase-shifting device.

The invention claimed is:

1. A device for phase-shifting a radiofrequency signal, comprising a first carrier (SF, SF', SF'', SF''') and a second carrier (SM, SM', SM'', SM'''), the first carrier (SF, SF', SF'', SF''') and the second carrier (SM, SM', SM'', SM''') being mounted so as to allow relative movement, an input port (PE) and an output port (PS) for radiofrequency signals being formed on the first carrier (SF, SF', SF'', SF'''), wherein the phase-shifting device comprises:

a first array of conductive pads (RP1, RP1', RP1'') that are distributed over the first carrier (SF, SF', SF'', SF''') and run from the input port (PE), a second array of conductive pads (RP2, RP2', RP2'') that are distributed over the second carrier (SM, SM', SM'', SM'''), the first carrier (SF, SF', SF'', SF'''), the second carrier (SM, SM', SM'', SM'''), the first array of conductive pads (RP1, RP1', RP1'') and the second array of conductive pads (RP2, RP2', RP2'') being arranged so as to form a structure for guiding radiofrequency signals of variable length having a rectangular cross section that connects the input port (PE) and the output port (PS), the first array of conductive pads (RP1, RP1', RP1'') and the second array of conductive pads (RP2, RP2', RP2'') being configured such that the cross section and the length of the guide structure change, over at least a portion of the path along which the radiofrequency signals propagate through the guide structure, as the first carrier (SF, SF', SF'', SF''') moves relative to the second carrier (SM, SM', SM'', SM''').

2. The device according to claim 1, the first array of conductive pads (RP1, RP1', RP1'') and the second array of conductive pads (RP2, RP2', RP2'') being coupled to a guided portion of constant dimensions (TGE, TGE', TGE'') at a first access (AC1, AC1', AC1''), the guided portion of constant dimensions (TGE, TGE', TGE'') being coupled, at a second access (AC2, AC2', AC2''), to a third array of conductive pads (RP3, RP3', RP3'') and to a fourth array of conductive pads (RP4, RP4', RP4''), the third array of conductive pads (RP3, RP3', RP3'') and the fourth array of conductive pads (RP4, RP4', RP4'') being arranged on the first carrier (SF, SF', SF'', SF''') and the second carrier (SM, SM', SM'', SM'''), respectively, the guide structure also being formed by the third array of conductive pads (RP3, RP3', RP3'') and by the fourth array of conductive pads (RP4, RP4', RP4'') such that the cross section of the guide structure changes, at the third array of conductive pads (RP3, RP3', RP3'') and the fourth array of conductive pads (RP4, RP4', RP4''), as the first carrier (SF, SF', SF'', SF''') moves relative to the second carrier (SM, SM', SM'', SM''').

3. The device according to claim 2, the second carrier (SM'') and the first carrier (SF'') being planar in shape and located one above the other with constant height, the second carrier (SM'') being able to move relative to the first carrier (SF'') along an axis of translation (X), the first array of conductive pads (RP1'') comprising two first rectilinear portions (PRE1, PRE2) that run parallel to the axis of translation (X), the two first rectilinear portions (PRE1, PRE2) being connected to one another by their ends via a first inclined portion (PI1) at a predetermined angle (θ) relative to the axis of translation (X), the second array of conductive pads (RP2'') comprising two second rectilinear portions (PRE3, PRE4) that run parallel to the axis of translation, the two second rectilinear portions (PRE3, PRE4) being connected to one another by their ends via a second inclined portion (PI2) at the predetermined angle (θ) relative to the axis of translation (X), the third array of conductive pads (RP3") and the fourth array of conductive pads (RP4") being arranged symmetrically with respect to a median plane (PM) containing the axis of translation (X), the input port (PE") and the output port (PS") being arranged symmetrically on either side of the median plane (PM), the guided portion of constant dimensions (TGE") being arranged under the second carrier (SM"), on the side opposite the first carrier (SF").

4. The device according to claim 1, the second carrier (SM, SM') and the first carrier (SF, SF') each being cylindrically shaped about an axis Z, the first array of conductive pads (RP1) comprising a first helical portion (PH1) on the axis Z, the second array of conductive pads (RP2) comprising a second helical portion (PH2) on the axis Z, the first helical portion (PH1) and the second helical portion (PH2) each being inclined by a predetermined slope.

5. The device according to claim 4, wherein the first array of conductive pads (RP1) and the second array of conductive pads (RP2) each comprise two straight portions (PDR1, PDR2, PDR3, PDR4) which lie mostly in planes that are orthogonal to the axis Z and are arranged on either side of the first helical portion (PH1) and the second helical portion (PH2), respectively.

6. The device according to claim 4, the second carrier (SM) being configured so as to be able to rotate within the first carrier (SF) about the axis Z, a guided portion of constant dimensions (TGE) passing diametrically through the second carrier (SM) on distinct planes along the axis Z from a first access (AC1) to the second access (AC2).

7. The device according to claim 4, the second carrier (SM') being configured so as to be able to rotate about the first carrier (SF'), the input port (PE') and the output port (PS') being coaxial to the axis Z, the input port (PE') being connected to the first array of conductive pads (RP1) and to the second array of conductive pads (RP2) via a first elbowed guide (GC1), the output port (PS') being connected to the third array of conductive pads (RP3) and to the fourth array of conductive pads (RP4) via a second elbowed guide (GC2), a guided portion of constant dimensions (TGE') being arranged around at least a portion of an annular periphery of the second carrier (SM').

8. The device according to claim 4, the third array of conductive pads (RP3, RP3') comprising a third helical portion and a fourth array of conductive pads (RP4, RP4') comprising a fourth helical portion, the third helical portion and the fourth helical portion being inclined by the predetermined slope and being coupled at the end to the output port (PS).

9. The device according to claim 1, the second carrier (SM'") and the first carrier (SF'") each being cylindrically shaped about an axis Z, the second carrier (SM'") being configured so as to be able to rotate within the first carrier (SF'"), a pin (PO) being arranged within a void (EV) in the second carrier (SM'"), the pin (PO) and the void (EV) being configured such that the rotation of the second carrier (SM'") about the axis Z results in a translational movement of the second carrier (SM'").

10. The device according to claim 9, the void (EV) taking a curved shape, the curved shape being configured so as to compensate for a nonlinearity in the phase variation as the second carrier (SM'") rotates about the axis Z.

11. The device according to claim 1, wherein the guide structure is a parallel-plate waveguide formed by a portion of the first carrier (SF, SF', SF", SF'") that is devoid of pads and has no pads facing it, and by a portion of the second carrier (SM, SM', SM", SM'") that is devoid of pads and has no pads facing it.

* * * * *